US005878804A

United States Patent [19]

Williams et al.

[11] Patent Number: 5,878,804

[45] Date of Patent: Mar. 9, 1999

[54] MULTIPROPERTY METAL FORMING PROCESS

[75] Inventors: Samuel B. Williams, Bloomfield Hills; Timothy A. Nielsen, Walled Lake, both of Mich.

[73] Assignee: Williams International Co. L.L.C., Walled Lake, Mich.

[21] Appl. No.: 900,972

[22] Filed: Jul. 25, 1997

Related U.S. Application Data

[63] Continuation-in-part of Ser. No. 789,647, Jan. 29, 1997.

[51] Int. Cl.[6] ..... B22D 17/00; B22D 19/16

[52] U.S. Cl. ..... 164/61; 164/113; 164/103; 164/900

[58] Field of Search ..... 164/900, 312, 164/113, 103, 61

[56] References Cited

U.S. PATENT DOCUMENTS 5,332,022 7/1994 Colvin ..... 164/98

5,638,889 6/1997 Sugiura et al. ..... 164/319

*Primary Examiner*—Kuang Y. Lin

*Attorney, Agent, or Firm*—Lyon, P.C.

[57] ABSTRACT

Methods for semisolid manufacturing of precision parts, turbine rotors for example, comprised of a plurality of high melting point alloys are given. Generally, a semisolid/thixotropic process is operated under vacuum utilizing a heated mold. The process preferably comprises a vacuum chamber, inductive heaters to bring two or more high melting point slugs to a either a solid or thixotropic phase, and a plunger that accelerates and injects a high melting point slug into the heated mold containing one or more solid or thixotropic slugs. The semisolid solution is eliminated as the completed forged assembly cools. Thixotropic forging of a multi-alloy assembly tailors its mechanical properties to achieve optimized properties in specific locations of the final product.

8 Claims, 4 Drawing Sheets

MULTIPROPERTY METAL FORMING PROCESS

CROSS-REFERENCE TO RELATED APPLICATIONS

The present application is a continuation in part of U.S. patent application Ser. No. 08/789,647, filed on Jan. 29, 1997.

BACKGROUND OF THE INVENTION

The present invention relates to methods of forming precision metal parts and, more specifically, to thixotropic forming of precision multi-alloy parts.

As performance criteria for turbine engines becomes more stringent, there is a need for an improved turbine rotor that exhibits maximum resistance to both fatigue and creep.

Die casting is a well-known process for producing complex components with excellent surface quality and good dimensional accuracy. However, the structural integrity of die castings is often compromised by air trapped in the casting upon injection of the liquid metal into the die casting cavity. The resultant porosity also compromises heat treatment of the casting which is often necessary to refine the grain structure and increase the strength of the casting.

Forging is also a well known process for producing relatively strong components having a desirable grain structure. However, forged products generally exhibit relatively low resistance to creep.

Thixotropic, or semisolid, metal forming is a viable alternative to traditional casting and forging methods. This process lies somewhere between a casting and a forging process in that the slug of metal to be formed will be brought to a "thixotropic" phase; that is, 30 or 40 percent of the mass will be in a liquid phase and the balance in a solid phase. The solid portion comprises small spherically-shaped nodules suspended within the liquid phase. Semisolid metals heated to a thixotropic phase exhibit unique rheological properties due to their non-dendritic, or spherical, microstructure. The rheological properties of the semisolid metal range from high viscosities, like table butter, for alloys at rest, to low viscosities, such as machine oil, as the shearing rate of the semisolid slug is increased. By heating the metals to a semisolid range and then agitating the semisolid alloy, the dendritic microstructure normally found is eliminated and replaced by the spherical microstructure. Upon solidification, the alloys then exhibit a fine equiaxed microstructure.

Normally, a highly viscous thixotropic slug will retain its outer shape provided there are no external forces, other than gravity, applied to it. However, its butter-like consistency is easily deformed to a low viscosity, particularly by a shearing action such as high velocity impact, making it extremely suitable when driving the alloy into the mold during the manufacturing process. Because semisolid-formed alloys exhibit an intermediate-sized grain structure, larger than forged grains and smaller than cast grains, it is expected that semisolid forged or cast alloys will have improved creep rupture resistance over traditionally forged alloys and improved strength properties over traditionally cast alloys.

The thixotropic process has been extensively studied by others in relation to lighter metals such as aluminum, magnesium, zinc, and copper alloys. However, very little research has occurred with regard to high temperature alloys commonly used in turbine rotors, including ferrous or nickel-based alloys. One significant difference between semisolid production for lighter alloys and that for high temperature alloys involves the adaptation of the process to the problematic and high heating temperatures of 2500° F. to 2700° F. as opposed to alloys in the 1200° F. melting point range. Designing a semisolid process compatible with such high heat has proven challenging. Generally, chrome-nickel alloys of, for example, 18% Cr and 82% Ni are used in turbine rotor forgings. This alloy has a solidus of 2550° F., and a liquidus of 2640° F. where the alloy is completely molten. The semisolid/thixotropic phase exists between the solidus and liquidus temperatures at temperatures ranging between 2550° F. and 2640° F. The alloy is commonly forged at temperatures below 2550° F., in the solid phase, and cast at molten temperatures above 2640° F., in the liquid phase.

Yet another problem that must be addressed is that current forging and casting equipment design includes permanent molds that often do not readily separate from the part interface when removing the turbine rotors and their intricate blades from the mold. This results in fractured or weakened blades and a corresponding number of rejected parts that do not meet design specifications. A need exists for semisolid manufacturing methods that facilitate ease of removal of the finished part, thereby improving the production volume and reducing the rejection rate of the finished parts.

Finally, precision metal assemblies are specifically designed to withstand various forces under uniquely stressful conditions. In certain applications, however, one part of a complete assembly may be exposed to stress and temperature loads significantly different from that of other parts integral to the same assembly. For example, the bore of a rotor may require good elongation, high strength, and good low cycle fatigue properties but may not require high temperature properties. In contrast, certain blade or rim portions of the rotor might require very high creep resistance and stress rupture strength at elevated temperatures. Formulating a single alloy capable of withstanding the variable stresses subjected to different locations within a precision metal assembly has also proven challenging. Therefore, a need exists for semisolid manufacturing methods that can be modified to vary the properties of different parts integral to a complete assembly.

SUMMARY OF THE INVENTION

The present invention solves the aforementioned problems by implementing a thixotropic process under vacuum for the production of turbine rotors and other parts of intricate design that comprise high melting point alloys. The mechanical properties of semisolid forgings are tailored by microstructure or metallurgical chemistry to achieve optimized properties in specific locations of the final product.

In accordance with the present invention, two or more high temperature slugs are first machined to fit within a heated mold, or alternatively, to fit within a heater elsewhere in the forging process. The slugs, each comprised of the same or different alloys may be either heated to a semisolid or solid state depending on design criteria.

In a first embodiment of the process, a first slug within the heater may be heated to a thixotropic or semisolid state while a second slug or plurality of slugs within the mold are concurrently heated but retained as solids. Once the desired liquid/solid thixotropic ratio is attained within the first slug, the semisolid slug is forged into the high temperature mold containing the solid alloys. Thus, the semisolid alloy is then forced into areas of the mold not occupied by the solid slug(s). Careful predetermined positioning of the solid slug ensures that the areas receiving the semisolid solution benefit from its respective properties once the completed assembly hardens, and the areas occupied by the solid slug(s) benefit from its respective properties once the assembly is completely forged.

In a second embodiment, a first slug positioned within the heater may alternatively be heated but retained within the solid state. A second slug positioned within the mold may be heated to a thixotropic semisolid solution. Once the desired liquid/solid thixotropic ratio is attained within the second slug, the solid first slug is forged into the mold thereby forcing the semisolid solution into predetermined areas dependent upon function.

The process described is particularly well suited for manufacturing turbine assemblies comprised of integrated bore, rim, and blade components. For example, to form a rotor assembly, the blade and rim alloy may be heated to a semisolid state within the mold. The bore alloy may then be heated but kept in the solid state, and then forged into the semisolid blade alloy within the die/mold. Upon impact from the solid slug, the semisolid slug will then extrude into the outer rim and blade areas of the mold.

Conversely, the bore alloy may be heated in the solid state within the mold, while the blade and rim alloy is heated to a semisolid state within the heater. The thixotropic blade and rim alloy can then be forged around the bore alloy, thereby exuding into the rim and blade areas of the mold.

Modified equipment design may be utilized in alternate embodiments of the high melting point semisolid process. Design flexibility may be enhanced by incorporating a plurality of two or more solid alloys in the heated mold and then forging a semisolid solution into the mold.

DETAILED DESCRIPTION OF THE PREFERRED EMBODIMENT(S)

Figure 1:
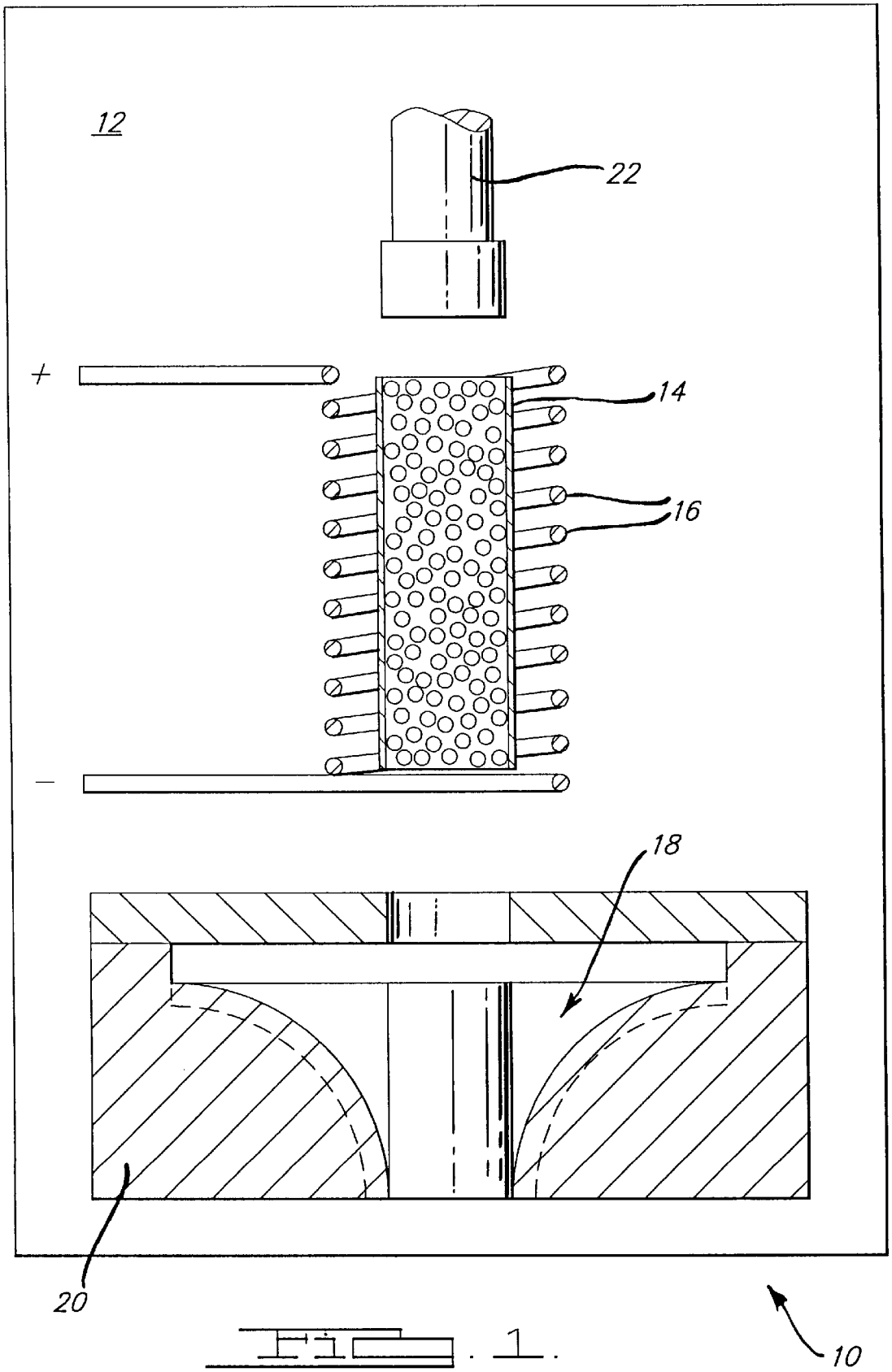
FIG. 1 illustrates the thixotropic process during the heating stage of a high temperature first slug, heated to a semisolid state within the process heater.
Figure 2:
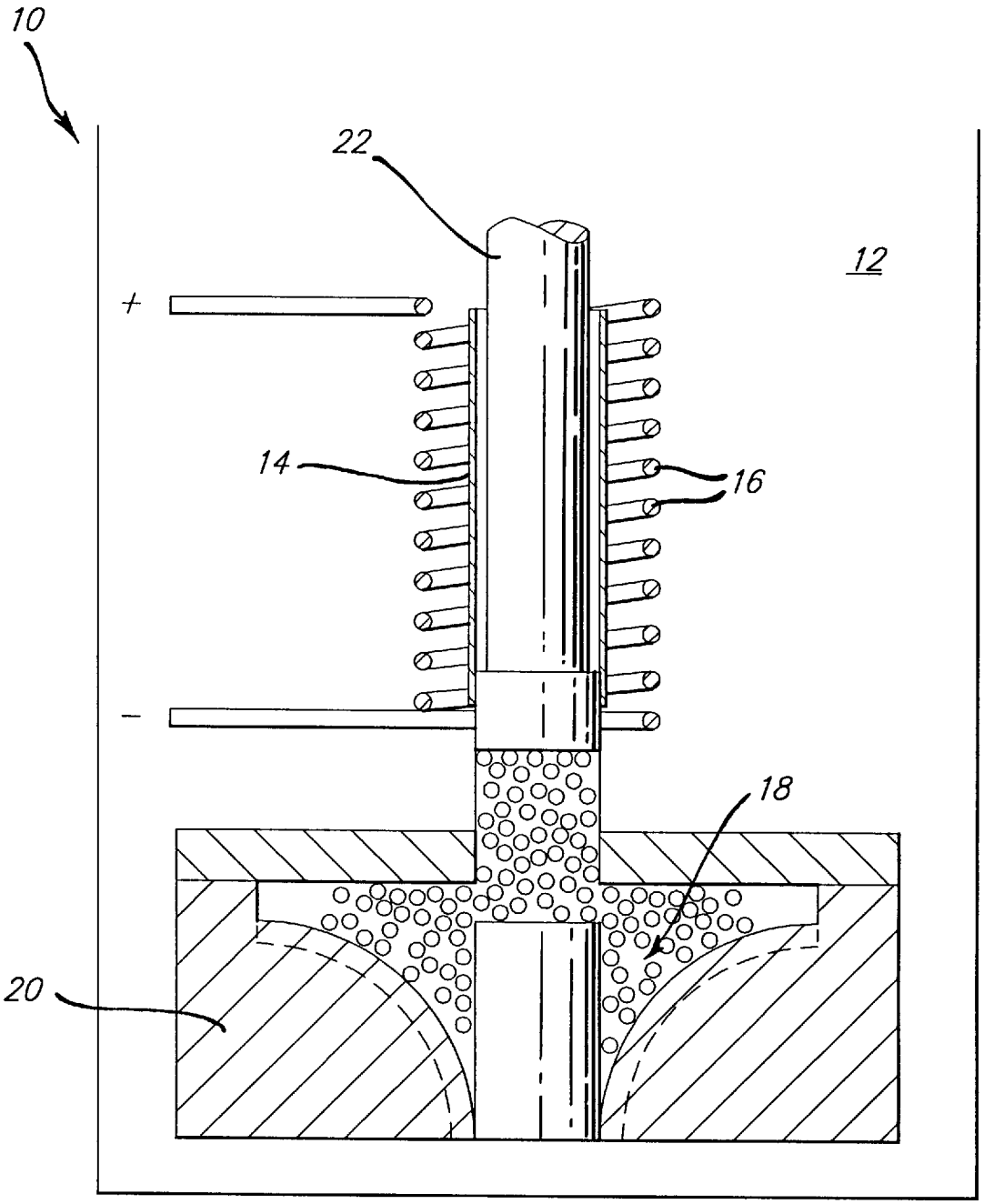
FIG. 2 illustrates the acceleration and injection of the semisolid slug into a heated mold containing a solid slug.
Figure 3:
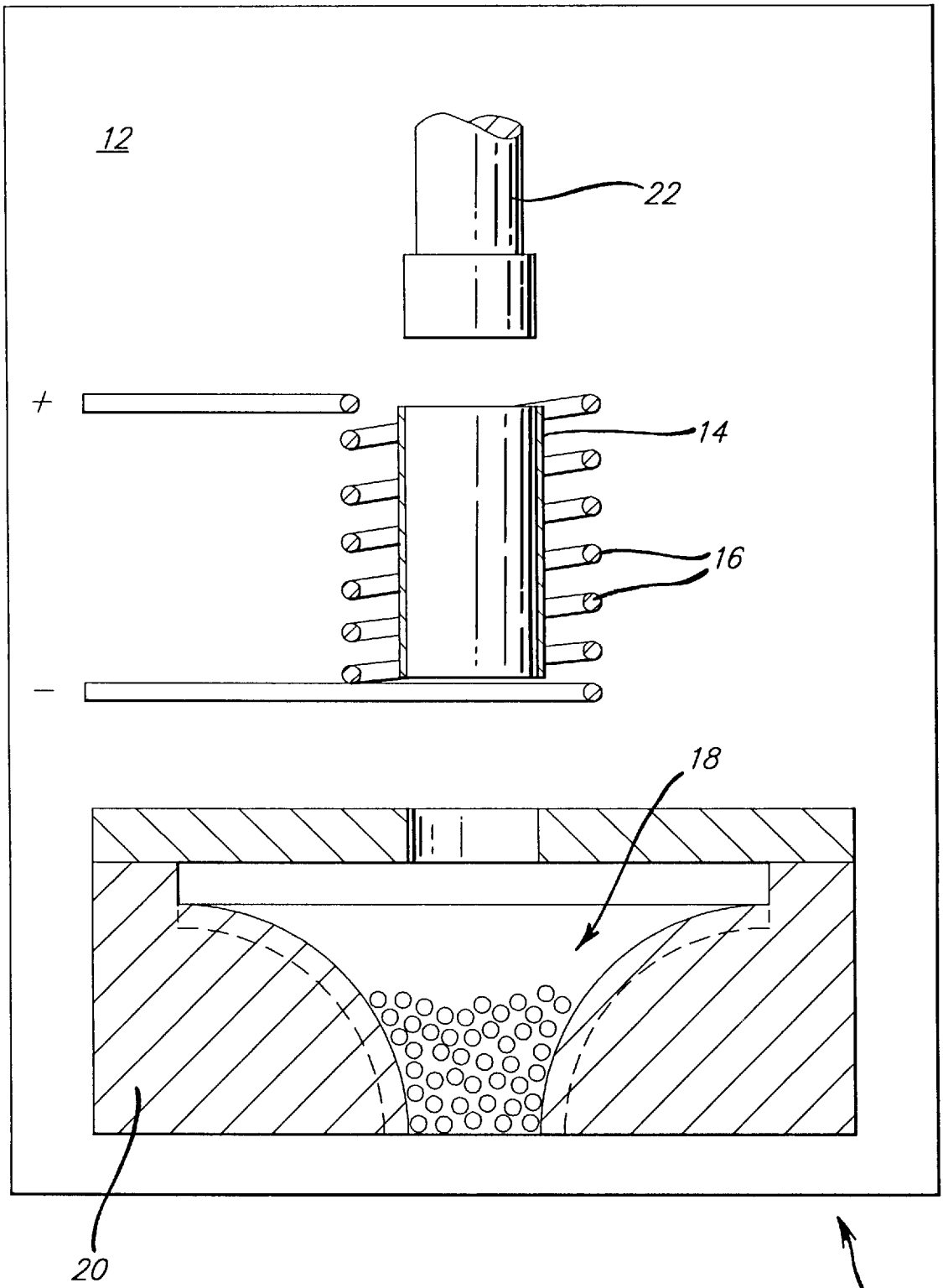
FIG. 3 illustrates a second embodiment, whereby the slug within the heater is heated to a solid state.
Figure 4:
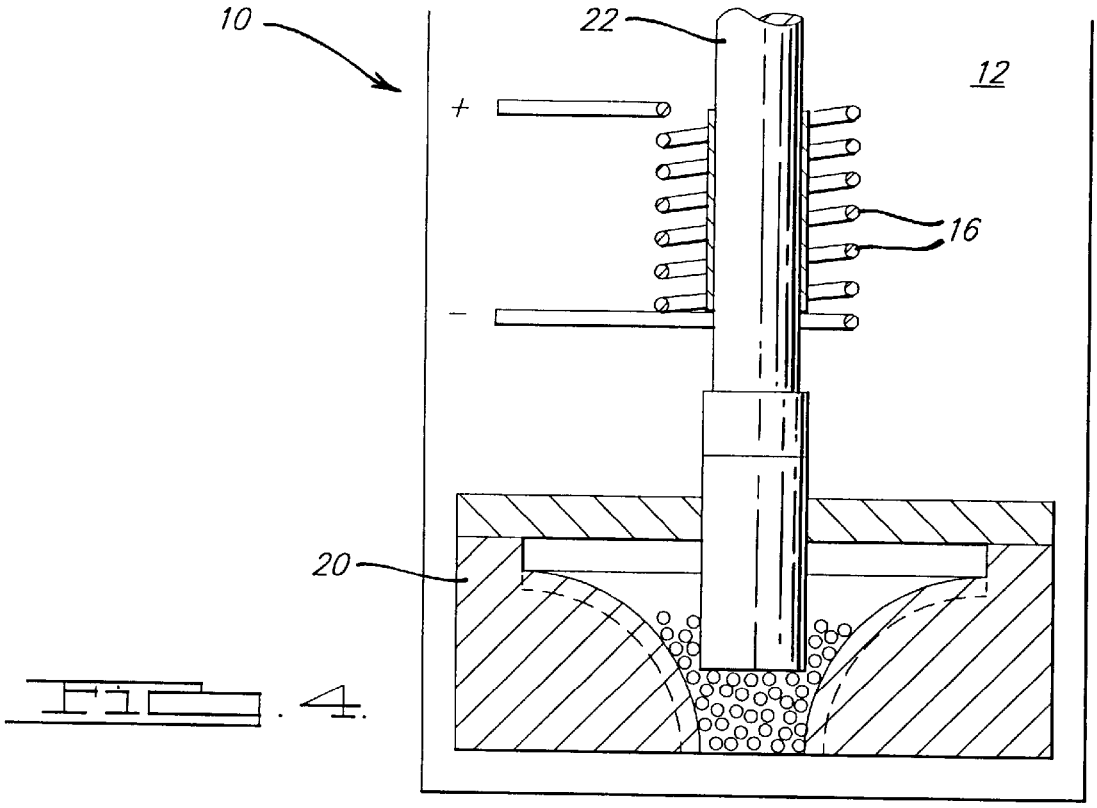
FIG. 4 illustrates the acceleration and injection of the solid slug into a heated mold containing a semisolid slug.
Figure 5:
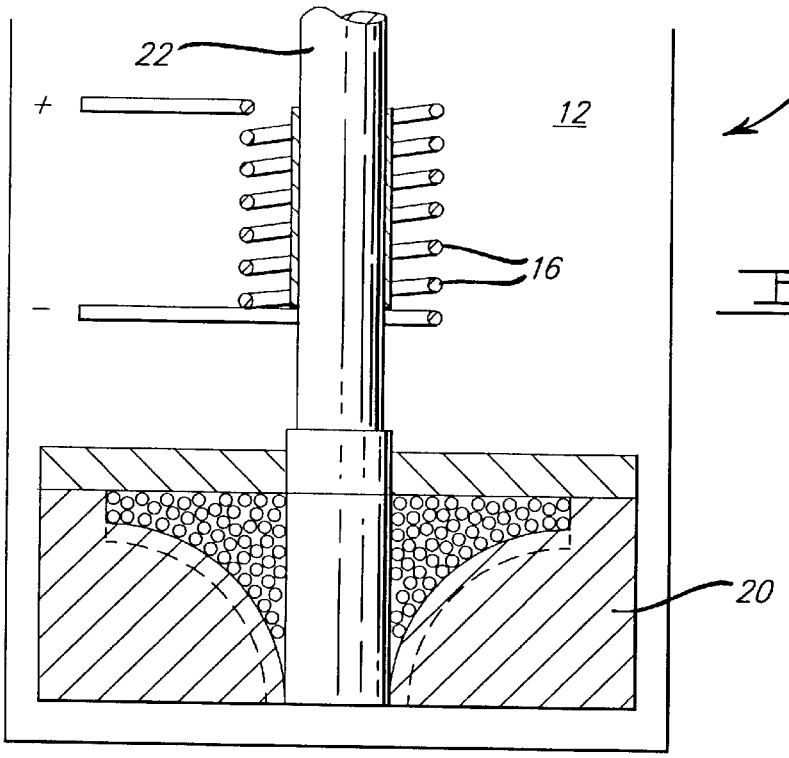
FIG. 5 illustrates the thixotropic process during the forming and solidification of the completed forged assembly.

In accordance with the present invention, a semisolid forging/casting process 10 is illustrated in the drawings, as it exists within a vacuum chamber 12. In accordance with a preferred embodiment of the present invention, an electrical inductive heater and tube 14 is located at upper and middle sections of the chamber 12. Induction heat elements 16 line the tube 14 generating a uniform heat throughout the uncooled portion of the vacuum chamber 12 thereby heating a multi-alloy slug therein. If the metal slug must attain a semisolid state, the induction heater 14 serves to heat and electrically "stir" the alloys thereby causing a shearing action and creating a thixotropic phase.

A mold 18 is located at the lower end of the vacuum chamber 12. The mold 18 is preferably inductively heated by heating jacket 20, but may also be heated resistively, by radiative heat, or otherwise.

The turbine blade portions of the mold are downwardly and bottomly positioned in the mold wherein the upper part of the mold is open-faced thereby allowing injection of the thixotropic alloy.

Before implementing the process, the slugs of high temperature alloys should first be machined to the approximate shape of the disc portion of the turbine with additional stock left on the back side of the disc shape. The excess stock should be great enough to more than fill the turbine blade cavities between the die segments when a respective slug is forced into the die 18.

In operation, the entire manufacturing process is conducted in a vacuum chamber to eliminate oxidation of the high temperature alloy and furthermore, to avoid formation of air pockets as the slug is accelerated into the die cavity. By decreasing the air pockets, porosity is decreased thereby permitting heat treatment and strengthening of the finished product.

Initially, a high melting point slug is inserted into the heater 14 and beneath the plunger 22. Concurrently, one or more alloyed slugs within the mold are heated but retained as solids. In a first embodiment of the process, a first slug within the heater may be heated to a thixotropic or semisolid state while a second slug or plurality of slugs within the mold are concurrently heated but retained as solids. Once the desired liquid/solid thixotropic ratio is attained within the first slug, the semisolid slug is forged into the high temperature mold containing the solid alloys. Thus, the semisolid alloy is then forced into areas of the mold not occupied by the solid slug(s). Careful predetermined positioning of the solid slug ensures that the areas receiving the semisolid solution benefit from its respective properties once the completed assembly hardens, and the areas occupied by the solid slug(s) benefit from its respective properties once the assembly is completely forged.

In a second embodiment, a first slug positioned within the heater may alternatively be heated but retained within the solid state. A second slug positioned within the mold may be heated to a thixotropic semisolid solution. Once the desired liquid/solid thixotropic ratio is attained within the second slug, the solid first slug is forged into the mold thereby forcing the semisolid solution into predetermined areas dependent upon function.

The process described is particularly well suited for manufacturing turbine assemblies comprised of integrated bore, rim, and blade components. For example, to form a rotor assembly, the blade and rim alloy may be heated to a semisolid state within the mold. The bore alloy may then be heated but kept in the solid state, and then forged into the semisolid blade alloy within the die/mold. Upon impact from the solid slug, the semisolid slug will then extrude into the outer rim and blade areas of the mold.

Conversely, the bore alloy may be heated in the solid state within the mold, while the blade and rim alloy is heated to a semisolid state within the heater. The thixotropic blade and rim alloy can then be forged around the bore alloy, thereby extruding into the rim and blade areas of the mold.

As the molded assembly cools, the thixotropic or semisolid phase is eliminated. The solidified alloy now possesses the properties advantageous in both the forging and casting processes such as high creep resistance, high strength, and low fatigue, and yet exhibits less shrinkage and gas porosity than castings.

Several features of the preferred method presented may be altered in various ways. For example, in lieu of a plunger 22, the acceleration step might include an electrical cannon or linear acceleration through an electric field as a method of driving the thixotropic rotor material into the mold 18. Alternatively, a vertical transfer tube extending from the upper induction heater 14 and down to the bottom mold 18 provides a gravitational means of acceleration. The vacuum chamber may incorporate a long vertical tube from 20 to 80 feet in height, having the inductive heater 14 at an upper end and inductive heating elements 16 lining the length of the vertical tube, thereby ensuring homogeneous heating throughout the tube. The thixotropic slug is then dropped accelerating to high velocity before impacting into the open face of the die. When the tapered disc shape of the slug impacts the die 18, the metal is extruded into turbine blade cavities within the die 18. This shearing action takes place at high velocity with the flow being equivalent to that of a low viscosity fluid. Once the shearing action stops, the viscosity increases and the part tends to hold its new shape. The surfaces in contact with the die cool rapidly to further retain shape integrity. As soon as the die is filled, the metal is trapped within because of the geometry of the blade shapes. As such, the metal will not tend to bounce upwardly and out of the die. The area of the vacuum chamber surrounding the die is kept at a very low temperature to ensure quick cooling before the next cycle.

The heater 14 and heating jacket 20 may provide heat in a variety of ways. Although the preferred embodiment utilizes an induction heater imparting a heating, stirring and shearing action to the high temperature rotor material, other heating methods include electrical resistive heating that would be incorporated in combination with alternate shearing methods such as tapered ramming of the slug. For example, the plunger used could be conically shaped and correspond to a conically shaped gate through which the semisolid slug would pass through as accelerated into the mold. As the semisolid slug passed from a larger diameter at an upper end of the gate to a smaller diameter at a lower end of the gate, compaction of the slug would provide the necessary shearing action. The heating and shearing parameters are critical in forming the thixotropic phase thereby preventing formation of the usual resultant dendritic microstructure and promoting a desirable nondendritic microstructure.

Finally, the solidification and forming step may utilize a mold 18 comprising high melting compounds. Materials useful in constructing a high temperature mold include castable zirconium, alumina, silica, and plaster.

Depending on designed properties of the finished part, the thixotropic process may comprise various solid/liquid percentages by adjustments in thermal processing. In other words, the temperature may be increased or decreased within the semisolid temperature range resulting in more or less of a liquid interphase, and variations in the final grain structure. This provides design flexibility and variability of the blade and bore properties of the rotor, thereby resulting in an optimum combination of mechanical properties tailored for specific applications.

While the preferred embodiment of the invention has been disclosed, it should be appreciated that the invention is susceptible of modification without departing from the scope of the following claims.

We claim:

1. A thixotropic shaping method of forming a multiproperty high melting point metal part comprising the steps of:

inserting a first high melting point metal slug within a first end of a vacuum chamber;

inserting a second high melting point metal slug within a die located at a second end of said vacuum chamber;

creating a vacuum within said vacuum chamber;

heating the first end of said vacuum chamber, whereby the metal slug therein remains solid;

heating said die thereby forming a semisolid metal within said second slug;

accelerating said first slug from the first end of said vacuum chamber, through a heated transfer tube and into said die thereby forcing said second slug into a predetermined area of said die;

cooling the semisolid metal and solid metal within said die thereby solidifying the high melting point metal therein; and removing the solidified multiproperty high melting point metal part from the die.

2. The method of claim 1, wherein heating said die comprises heating said second high melting point slug to form a semisolid metal comprising about 60–70% solids.

3. The method of claim 2 wherein said accelerating step comprises:

accelerating said first high melting point slug into said die by actuating a pneumatic plunger.

4. The method of claim 1, wherein said accelerating step comprises gravitationally accelerating the first slug into said die.

5. The method of claim 1, wherein said accelerating step comprises accelerating the first slug into said die by utilizing an electric cannon, and generating linear acceleration through an electric field.

6. The method of claim 1, wherein said accelerating step comprises accelerating the first slug into said die by actuating a plunger.

7. The method of claim 1 wherein the die is resistively heated.

8. The method of claim 1 wherein the die is inductively heated.

* * * * *